United States Patent [19]

Kahan

[11] Patent Number: 4,686,734

[45] Date of Patent: Aug. 18, 1987

[54] SPILL INHIBITING DUST PAN

[76] Inventors: Alexander Kahan, a.k.a. Charles Alexander, P.O. Box 30722, Oakland, Calif. 94604

[21] Appl. No.: 796,161

[22] Filed: Nov. 8, 1985

[51] Int. Cl.[4] ..... A47L 13/52

[52] U.S. Cl. ..... 15/257.1; 15/257.9; 294/55

[58] Field of Search ..... 15/257.1, 257.2, 257.4, 15/257.7, 257.6, 257.8, 257.9; 32/74; 294/1.4, 1.5, 55

[56] References Cited

U.S. PATENT DOCUMENTS 203,885 5/1878 Button ..... 294/55
1,262,294 4/1918 Wright ..... 15/257.9 X
1,982,182 11/1934 Stover ..... 15/257.7
2,666,309 1/1954 Anderson et al. ..... 15/257.9

FOREIGN PATENT DOCUMENTS 137452 5/1950 Australia ..... 15/257.9

*Primary Examiner*—Edward L. Roberts
*Attorney, Agent, or Firm*—George W. Wasson

[57] ABSTRACT

A dust pan form and design that permits the user to clean-up more effectively dust or debris from a surface. The dust pan has the particular feature of having an element that is flexible and transparent so as to conform to the surface being cleaned while permitting the use to see through the element to the surface.

8 Claims, 5 Drawing Figures

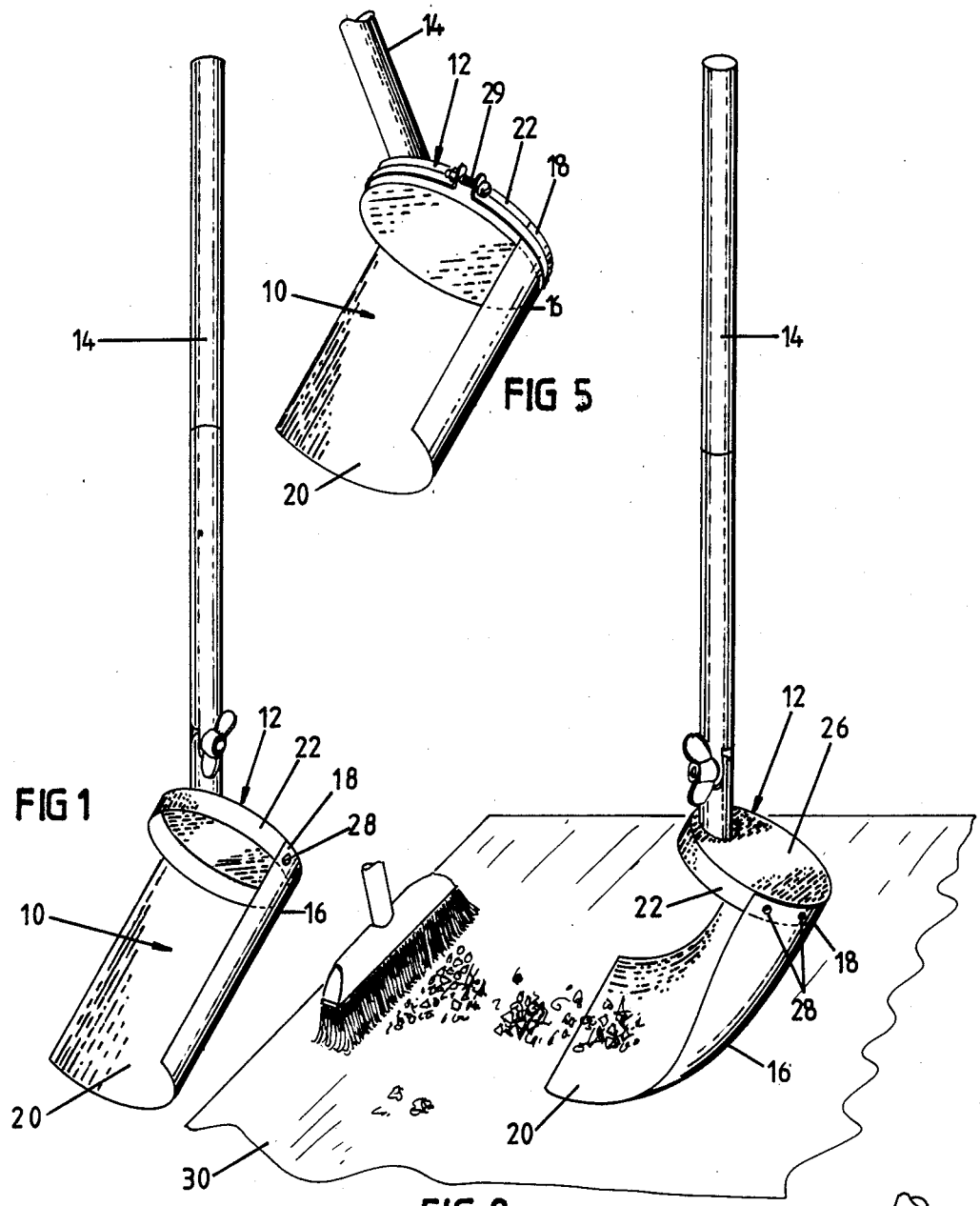
FIG 5
FIG 1
FIG 2
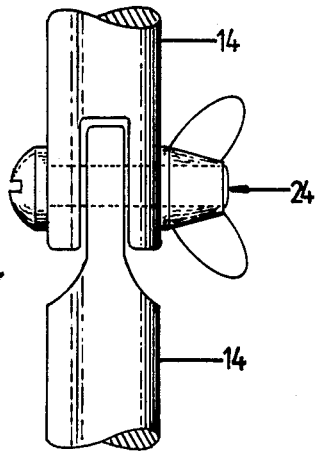
FIG 4
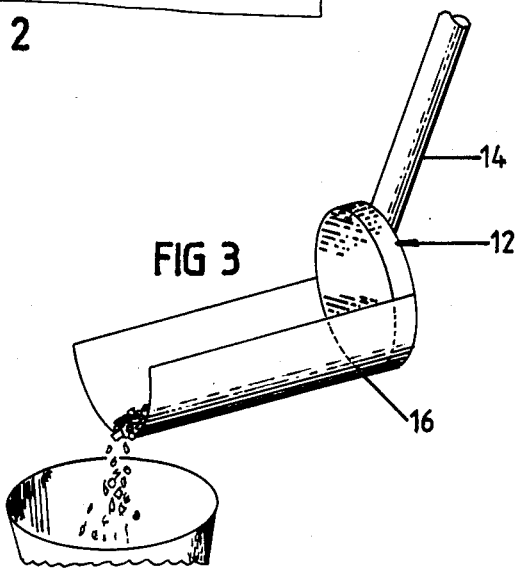
FIG 3

SPILL INHIBITING DUST PAN

This invention relates to a new and improved design and construction for a spill inhibiting dust pan and more particularly to a dust pan form and design that permits the user to clean-up more effectively dust or debris from a surface. The dust pan has the particular feature of having an element that is flexible and transparent so as to conform to the contour of the surface being cleaned while permitting the user to see through the element to the surface.

BACKGROUND OF THE INVENTION

Household shovel like devices that are used to clean up spills or the like are usually referred to as dust pans because their usual use is for cleaning dust or other accumulated debris from a floor or the like. The usual dust pan comprises a handle attached to a wide, flat plane-like member into which the debris is swept. Many forms of dust pans have been proposed including some that have flexible elements at the open end of the flat plane to permit the plane to more nearly conform to the contour of a surface. Those dust pans with flexible attachments have only been as effective at conforming to the surface being cleaned as the flat plane permits flexibility and have been ineffective in containing the collected debris after the cleanup is completed. Other dust pans have provided a storage area for the collected debris in the form of a bag or pocket for containing the debris. None of the prior art dust pans known to the present inventor are capable of providing an effective scoop surface that will both conform to the contour of the surface being cleaned and will contain the collected debris after the scoop surface is removed from its contact with the cleaned surface.

OBJECTS AND FEATURES OF THE PRESENT INVENTION

The present invention provides a dust pan device that will conform to a surface being cleaned, will contain the collected debris moved into the device and will permit the user to see where debris remains under the device.

It is an object of the present invention to provide a dust pan like device that can be used from a standing position permitting the user to hold the pan with one hand while sweeping debris into the pan with a tool held in the other hand.

A further object in accord with the preceding object is to provide a dust pan like device that will permit the user to conform the collecting or open end to the pan with the surface being cleaned and permit the user to remove the open end from the cleaned surface in a manner that will contain the collected debris within the pan because the pan then conforms to its original form establishing a pocket for the collected debris.

Further objects and features of the present invention will be readily apparent to those skilled in the art to which the invention pretains from the appended drawings and specification illustrating preferred embodiments of the invention.

BRIEF DESCRIPTION OF THE DRAWINGS

FIG. 1 is a perspective side elevational view of the assembled dust pan of the present invention.

FIG. 2 is another perspective view illustrating the dust pan of the present invention in use and with the scoop portion in contact with a surface.

FIG. 3 is a perspective view illustrating the dust pan in an mode for emptying its contents.

FIG. 4 is an enlarged front elevational view of an adjustable feature of the present invention.

FIG. 5 is a partial perspective view illustrating an alternative form for assembling portions of the present invention.

DETAILED DESCRIPTION OF THE DRAWINGS

The dust pan apparatus 10 as illustrated in the drawings comprises a rigid member 12, a handle member 14 fixed to one surface of the rigid member, and a flexible member having a fixed end at 18 and a free end at 20. The fixed end 18 of the flexible member is fixed to the outer surface 22 of the rigid member 12 and the free end 20 of the flexible member extends a substantial distance from the rigid member on the opposite side of the rigid member from the handle member in a direction to be substantially perpendicular to the plane of the rigid member when in a relaxed condition. The handle member 14 is preferrably fixed to the rigid member 16 at an oblique angle to the plane of the rigid member and is rigidly fixed thereto.

A possible modification of the dust pan of the present invention includes an angularly adjustable connection in the handle as illustrated in FIG. 4 to permit the angular relationship between the plane of the rigid member 12 and the handle 14 to be adjusted. As illustrated in FIG. 4 the adjustment may be accomplished with a rotatable connection between portions of the handle 14 and a bolt and wing nut locking mechanism at 24.

As illustrated in assembled and relaxed condition in FIG. 1 the dust pan of the present invention aligns the flexible member 16 in the contour of the rigid member 12. In this relaxed condition the flexible member is biased toward the contour of the rigid member. In the preferred form the flexible member 16 is a transparent material, such as a clear plastic material like mylar film, so that a user of the dust pan may see through the flexible member to a surface below the pan. The flexible member 16 is of a sufficient thickness to establish reasonable rigidity along its dimension from the rigid member 12 but is flexible enough to flatten when pressed against a surface. For that purpose the flexible member should be at least 20 mils.

One form of rigid member 12 comprises a cap or disk like member having a cylinderical outer surface portion like that shown at 22 and a back surface like that shown at 26 in FIG. 2. With such a surface the flexible member 16 may be attached to the surface 22 by suitable means such as the screws or rivets as illustrated at 28. Other suitable connection of the flexible member 16 to the rigid member 12 can be equally effective. As shown in FIG. 5 a clamp or band surrounding the surface 22 and enclosing the flexible member may be used.

The feature of the dust pan of the present invention that makes it more efficient and convenient is illustrated in FIG. 2 where the dust pan's flexible member 16 is shown with its free end 20 in contact with and flattened against a surface 30. As illustrated in the FIG a broom or the like may be used to push debris or dust onto the flattened surface and toward the rigid member 12. The flexibility oif the flexible member 16 permits the free end 20 to flatten against the surface while the sides near the fixed end 18 retain their cupped form in accord with the contour of the rigid member 12. When the debris or dust has been pushed entirely within the flexible member 16 the flattened surface may be removed from the surface 30 and the flexible member will then resume the contour or the rigid member 12, even at the free end thereof, so as to contain the collected material. Then, as illustrated in FIG. 3, the flexible member will function as a guide or shoot for dumping the collected material into a receptacle or the like.

The transparent form for the flexible member permits a user to see through the flexible member 16 to a surface or to a receptacle to see materials to be collected and to see the place where the collected materials are to be dumped. The flexibility of the flexible member permits the dust pan to be effective in providing a flat surface onto which materials may be collected. The surface has enough flexibility to assume the contour of the surface to be cleaned and to provide a smooth entry way for the collected materials.

While the handle for the dust pan has been illustrated as a sectional element such a handle may be one piece. A handle may be as long as is needed to permit the user to stand erect while collecting material from a surface. The adjustable feature illustrated in FIG. 4 permits the assembled dust pan to be used in a variety of angles and permits the assembled device to be stored with the pan portion hanging substantially straight down from the handle thus consuming less storage space.

While certain preferred embodiments of the invention have been specifically illustrated and disclosed, it should be understood that the invention is not to be limited thereto as many variations will be readily apparent to those skilled in the art and the invention is to be given its broadest possible interpertation within the terms of the following claims.

I claim:

1. A dust pan or the like for collecting movable materials from a surface to be cleaned, said dust pan comprising;

(a) a rigid member, said rigid member having a body portion including a planar cross-section and an outer peripheral surface, said outer peripheral surface having at least a portion thereof establishing a convex surface substantially perpendicular to said planar cross-section, (b) a handle member fixed to said body portion of said rigid member at one edge thereof, (c) a flexible member, said flexible member having a fixed end and a free end, said fixed end of said flexible member being fixed to said outer portion of said peripheral surface of said rigid member and said free end of said flexible member extending away from said rigid member at the edge of said rigid member opposite said fixed connection of said handle member to said one edge of said body portion, said flexible member extending away from said rigid member at said opposite edge thereof a substantial distance, (d) said handle and rigid member cooperating with said flexible member to cause said free end of said flexible member to be pressable against said surface to be cleaned while said fixed end of said flexible member is being held by said outer peripheral surface of said rigid member to collect said materials being cleaned from said surface, (e) and said flexible member being self biased by said fixed connection to said outer periphery of said rigid member to return to the configuration of said outer peripheral surface of said rigid member when said handle and rigid member release said flexible member from said surface being cleaned.

2. The dust pan of claim 1 wherein said handle is fixed to said rigid member so that said handle extends from said body portion of said rigid member at an oblique angle with respect to said planar cross-section of said rigid member.

3. The dust pan of claim 2 with the addition of a means between said rigid member and said handle for adjusting said oblique angle between said body portion of said rigid member and said handle.

4. The dust pan of claim 1 wherein said handle is sectional with mating joints between sections of said handle.

5. The dust pan of claim 1 wherein said flexible member is transparent.

6. The dust pan of claim 1 wherein said outer peripheral surface of said rigid member is cylinderical in shape.

7. The dust pan of claim 1 wherein said rigid member is disk-shaped.

8. A dust pan or the like for collecting movable materials from a surface to be cleaned, said dust pan comprising;

(a) a rigid member, said rigid member having a body portion including a planar cross-section and an outer peripheral surface, said outer peripheral surface having at least a portion thereof establishing a surface substantially perpendicular to said planar cross-section, said portion of said outer peripheral surface further having a smooth outer surface forming at least a portion of a cylinder, (b) a handle member, said handle member being fixed to said body portion of said rigid member at one edge of said body portion, said handle member extending from said body portion of said rigid member at an oblique angle with respect to said planar cross-section of said rigid member, (c) a flexible member, said flexible member having a fixed end and a free end, said fixed end of said flexible member being fixed to said smooth outer surface of said outer peripheral surface of said rigid member, said free end of said flexible member extending away from said rigid member at the edge of said rigid member opposite said fixed connection of said handle member to said one edge of said body portion, said flexible member extending away from said rigid member substantially perpendicular to said planar cross-section at said opposite edge thereof a substantial distance, said flexibility of said flexible member permitting said free end of said flexible member to flex while said fixed end of said flexible member maintains the form of said smooth outer surface of said portion of said outer peripheral surface, (d) said handle and rigid member cooperating with said flexible member to cause said free end of said flexible member to be pressable against said surface to be cleaned while said fixed end of said flexible member is being held by said smooth outer surface of said outer peripheral surface of said rigid member to collect said materials being cleaned from said surface, (e) and said flexible member being self biased by said fixed connection to said smooth outer surface of said outer peripheral surface of said rigid member to cause said free end of said flexible member to return to the configuration of said outer peripheral surface of said rigid member when said handle and rigid member release said flexible member from said surface being cleaned.

* * * * *